United States Patent [19]

McBride

[11] Patent Number: 5,022,891

[45] Date of Patent: Jun. 11, 1991

[54] JET REDUCTION DISCHARGE OF DYE COLOR

[75] Inventor: Daniel T. McBride, Chesnee, S.C.

[73] Assignee: Milliken Research Corporation, Spartanburg, S.C.

[21] Appl. No.: 516,361

[22] Filed: Apr. 30, 1990

[51] Int. Cl.[5] ..... D06P 5/15

[52] U.S. Cl. ..... 8/457; 8/455; 8/456; 8/458

[58] Field of Search ..... 8/457, 458, 455, 456

[56] References Cited

U.S. PATENT DOCUMENTS

| | | | |
|---|---|---|---|
| 2,248,128 | 7/1941 | Seymour et al. | 8/64 |
| 3,972,677 | 8/1976 | Feess et al. | 8/69 |
| 3,999,940 | 12/1976 | Freeman | 8/14 |
| 4,398,914 | 8/1983 | Blum et al. | 8/456 |
| 4,441,883 | 4/1984 | Vavala | 8/457 |
| 4,610,802 | 9/1986 | Fujiyasu et al. | 252/188 |

FOREIGN PATENT DOCUMENTS 0719089 11/1954 United Kingdom .

OTHER PUBLICATIONS

G. Bertolina et al., "Coloured Discharge Technique," 25-Dyes and Textile Chemistry 4513, *Rayon and Synthetic Fibres Supplement,* Nov. 11, 1955, pp. 775-779.

P. Krug, "Manofast in Textile Printing," *Rayon and Synthetic Fibre Supplement,* Dec. 9, 1955, pp. 939-947.

*Primary Examiner*—Josephine Barr
*Assistant Examiner*—William S. Parks
*Attorney, Agent, or Firm*—Timothy J. Monohan; H. William Petry

[57] ABSTRACT

The process for producing patterns on ground dye colored textile fiber pile substrates, particularly wherein the pile fibers are in the form of yarns comprised predominantly of polyamide fiber, and wherein at least some of the ground dye component is at least partially color dischargeable and selected from vat, reactive, direct, acid, premetallized or mordant dyes, the process comprising contacting selected portions of the colored pile fibers with a reducing system which optionally can contain one or more reduction resistant dye or pigment materials for in situ coloring of the substrates, the contacting being characterized by jet forcing the reducing system interstitially of the pile fibers to deposit the reducing system thereon substantially below the surface thereof, and to effect the color discharge of at least a portion of the ground dye component.

28 Claims, 10 Drawing Sheets

JET REDUCTION DISCHARGE OF DYE COLOR

This invention relates to the selective area discharge of dye color for producing color patterns on various dyed substrates, and particularly concerns the discharging of dye color deep into carpet or upholstery pile or other heavy fabric substrates by means of jet forcing a dye reducing system of unique composition interstitially of the yarn or fiber piles, with or without concurrent dyeing of the substrates with other chemically stable dyes and/or pigments.

The technique of producing color patterns on various dyed fabric substrates, herein termed ground shade or ground dyed, by contacting selected portions of the substrate with a dye reducing system to discharge the color within a desired pattern, is known to the art as exemplified by U.S. Pat. Nos. 2,248,128; 4,441,883; and 4,610,802; the article by P. Krug, pp 606-611, entitled Thiourea Dioxide (Formamidinesulphinic Acid) *A New Reducing Agent for Textile Printing*, J.S.D.C. 69, December 1953; and the article by G. Bertolina, et al, *Coloured Discharge Technique*, Dyer, 114, pp 775-779 (1955), the disclosures of all of which are incorporated herein by reference.

The application methods heretofore employed for contacting the various substrates with dye reducing agent include screen, roller, pad, or the like, printing techniques which are somewhat effective for substantially flat or relatively mildly textured substrates, but which are ineffective for pile fabrics such as deep pile rugs, carpets, upholstery or the like. In this regard, attempts to discharge all or substantially all of the ground dye color within a pattern from pile carpeting using the above known techniques, in a reasonable number of passes through the reducing apparatus and in a reasonable processing time, with a reasonable degree of effectiveness have not been successful, particularly where heavy ground shades are involved and where discharge of substantially all color in the treated area is desired.

Objects, therefore, of the present invention are: to provide a commercially viable process for the effective redox discharging of dye color from difficult substrates such as polyamide, polyester, wool or acrylic fiber pile substrates; to provide specially adaptable equipment for carrying out the process in continuous or semi-continuous manner; and to provide specially formulated reducing systems for use in the aforesaid equipment, which systems per se, possess improved reducing and color discharge capability.

These and other objects hereinafter appearing have been attained in accordance with the present invention through the discovery, which in its process embodiment of producing patterns on ground dye colored textile pile substrates, particularly wherein the pile yarns thereof are comprised predominately of polyamide fiber, and wherein at least some of the ground dye component is color dischargeable (i.e., totally or partially) and is selected from vat, reactive, direct, disperse, acid, premetallized or mordant dyes, comprises contacting selected portions of the colored pile yarns with an aqueous reducing system, the contacting being characterized by jet forcing the reducing system interstitially of the pile fiber or yarns to deposit the system thereon substantially below the outer surface or loops of the pile or outer ends of the fibers and effecting the color discharge of at least a significant portion of the ground dye component.

In certain preferred embodiments of the process:

(a) the pile fibers or yarns (substrate) are steamed after treatment with the reducing system to enhance the color discharge;

(b) the reducing system comprises an aqueous composition of water soluble reducing materials, with or without reduction resistant dye, and is metered onto the pile yarns at a velocity from about 2.0 to about 20.0 meters per second, most preferably from about 4.0 to about 12.0 meters per second;

(c) the pile fibers or yarns are contacted and substantially coated with a reducing system to at least about one half of their lengths;

(d) the aqueous reducing system composition comprises in grams/kilogram from about 1.0 to about 50 zinc sulfate, from about 3 to about 30 thiourea dioxide, from about 1.0 to about 20 xanthan gum, and up to about 20 of non-reducible dye;

(e) the pile fibers or yarns are pre-dyed to a ground shade with color dischargeable dyes and the process discharges essentially all of the color of said ground shade;

(f) the substrate of (e) is concurrently dyed with reduction resistant dye; and (g) the reducing agent is selected from thiourea dioxide, zinc formaldehyde sulfoxylate, or sodium formaldehyde sulfoxylate.

The invention will be further understood from the following description and drawings wherein.

Figure 12:
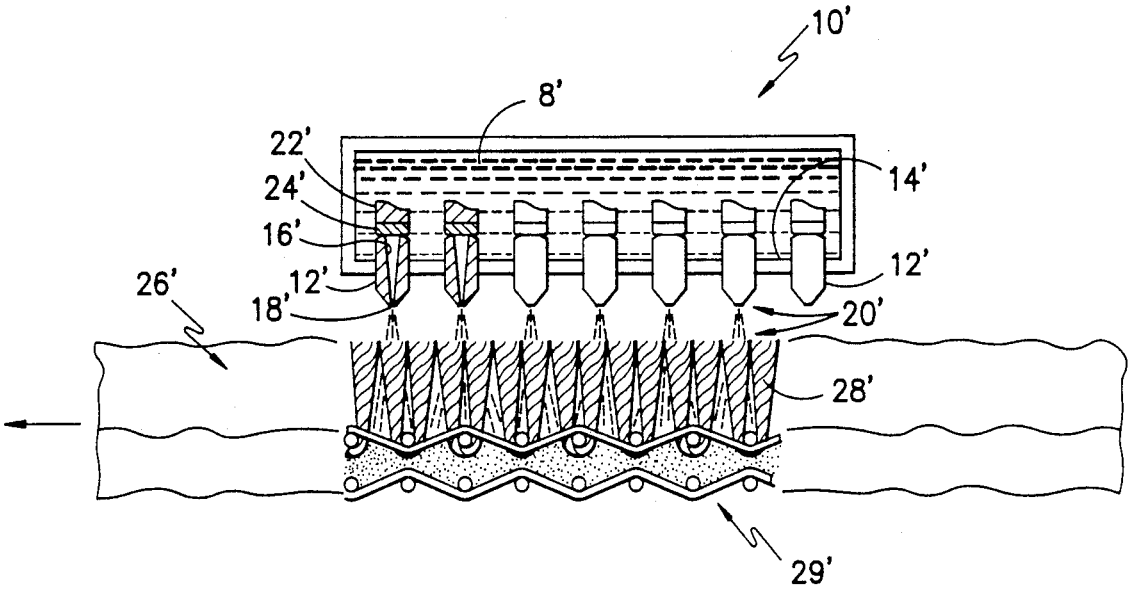
FIG. 12 is a longitudinal cross-sectional view of a rudimentary jet printing bank useful in the present process for applying a reductant system to a moving or stationary pile substrate shown in enlarged dimensions for purposes of clarity.
Figure 13:
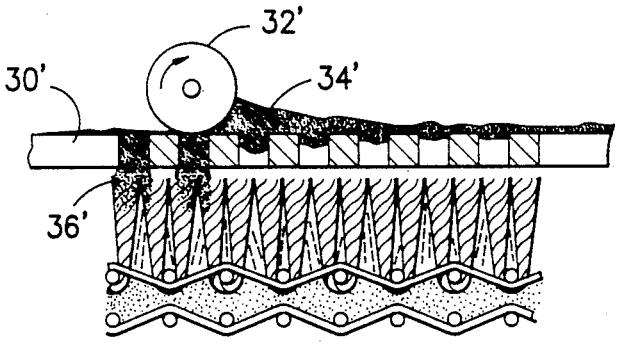
FIG. 13 is a longitudinal cross-sectional view of a screen applicator in operation applying a reductant paste material such as recipe 2 described below.

Referring to FIGS. 12 and 13, an exemplary, simplistic form of jet dyeing machine is shown for purposes of illustrating the pattern of jetted reduction system of the present invention with respect to the pile substrate. In this machine an aqueous reducing system 8' of a composition in accordance with the present invention such as recipe 3 described in detail below, is loaded into a pressure plenum generally designated 10' which is provided with a plurality of fluid jets 12' sealingly affixed in the plenum floor 14'. The jets are provided with flow passages 16' and jet orifices 18' of dimensions suitable for metering a prescribed reductant system spray pattern such as is generally designated 20'. For the preferred reductant recipes or compositions given below, an orifice diameter of from about 0.006 to about 0.30 inches is satisfactory for general pile substrate applications.

In this rudimentary but operable apparatus, the inlet ends of the jet passages are closed or opened by valve plungers 22' provided with sealing discs 24' of suitable tough and chemically resistant material such as Teflon or the like. These plungers may be connected in a bank so as to operate in unison or they may be individually controlled by camshaft means or the like, including computer controlled means, to open and close the flow passages in any sequential or intermittent pre-programmed manner.

The textile pile substrate (carpet) shown generally as 26' is typical of the pile configuration for which the present invention offers unusually marked advantages. It is noted that the pile is shown as individual fibers, however, the term pile as used herein include looped pile fibers and any other such substrate configuration. The dotted, spray pattern jet lines 20' shown in FIG. 12 illustrate the depth to which the jetted reducing system is readily forced interstitially of the yarn piles 28'. Depending, for example, on the viscosity of the reducing recipe, the pressure in the plenum 10', the jet orifice size, or any combination of such parameters, the reducing system can be readily jetted all the way down the yarn pile to the backing generally designated 29'. In this regard it is particularly noted that markedly superior uniformity in final dyeing and color appearance of the carpet is unexpectedly achieved when the present jet reduction process is applied to a ground shade dyed carpet, both when a concurrent non-reducible dye component is included in the reducing system, or when the final dyeing is made in a subsequent dyeing operation. It is believed that this improvement in final color appearance results from color discharge of the ground shade to a greater pile depth as well as to a more uniform discharge shade or non-color, through a more intimate contacting of the individual fibers with the present comparatively low viscosity and highly mobile reducing system. In contrast, a screen, roller, pad or the like contact applicator such as shown in FIG. 13 as screen 30', roller 32', and discharge paste 34', provides no means for achieving deep and uniform penetration of the reducing system, except perhaps by multiple, e.g., as many as 10–20 passes of the applicator across the carpet, as compared to a single pass through the present jet applicator. It has been Applicant's experience that such application methods as shown in FIG. 13 gives only little pile penetration as indicated at 36'.

The plenum 10' is preferably maintained at a pressure of from about 3–15 psi and the jets are dimensioned to provide the aforesaid reductant velocity of from about 2.0 to about 20.0, preferably from about 4.0 to about 20.0 meters per second. The plenum is preferably integral with a closed loop pressure feed apparatus in which the reducing system is continuously replenished and circulated by suitable pumping means. Such pressure feed apparatus useful in the present invention is described in several U.S. patents referred to below. The number of jets 12', their size, number and geometrical arrangement or pattern relative to the substrate can be varied by one skilled in the art to achieve a desired reductant lay-down pattern. Also, as aforesaid, the sequence or plan of their operation can be widely and intricately varied, as can the mechanical or other control means for actuating the valve plungers or other equivalent valving devices.

In the more sophisticated jet apparatus as shown in FIGS. 1–11, wherein the chemical jet streams are of the continuous flow type, each individual chemical jet stream may be intermittently interrupted or diverted in accordance with pattern information. The apparatus generally comprises a conveyor which transports the substrate to be chemically treated, e.g., with reducing system and/or dye, to and under a plurality of continuously flowing, discrete chemical solution or dispersion jet streams. In a preferred embodiment, a plurality of jet orifices, each directed at the substrate, are arranged in several individual linear arrays positioned generally above and across the substrate path in spaced, parallel alignment, with each array being associated with a separate source of chemical, e.g., a different reducing system and/or a different color of liquid dye material. Generally, each of the arrays is positioned in close proximity to the substrate to be treated, with typical clearance between the array and the substrate surface being substantially less than one inch. The individual continuously flowing chemical jet streams in a given array are normally directed onto the substrate surface, however, by means of a transverse intersecting stream of diverting air which is provided for each chemical jet stream and which is actuated or interrupted in response to externally supplied pattern information, each chemical jet stream may be readily re-directed in a pre-planned manner into a collection chamber or catch basin so as to prevent the chemical from inadvertently contacting the substrate.

To accurately control the amount of chemical applied to a given location on the substrate during the treating operation, and to insure that each chemical jet stream strikes the substrate in a very small, precise spot, the lower portion of the collection chamber contains a collector plate supportably positioned in spaced relation above the lower wall of the collection chamber. This collector plate is adjustably attached to the lower wall of the collection chamber by way of an elongate collector plate support member which forms an extension of the lower wall of the collector plate relative to the collector plate support member. The leading edge of the collector plate can thus be accurately positioned relative to the chemical discharge or jet axes of the array to insure prompt and precise interception of the jet streams when deflected. Details of such apparatus and collection chamber construction are described and claimed in commonly assigned U.S. Pat. No. 3,942,343 further referred to below. As described therein, each chemical jet stream, when deflected, passes across the edge of the collector plate and into the collection chamber. Upon removal of the deflecting air stream, the chemical jet stream moves back across the plate edge and resumes its normal path of travel toward the substrate to be dyed.

Figure 1:
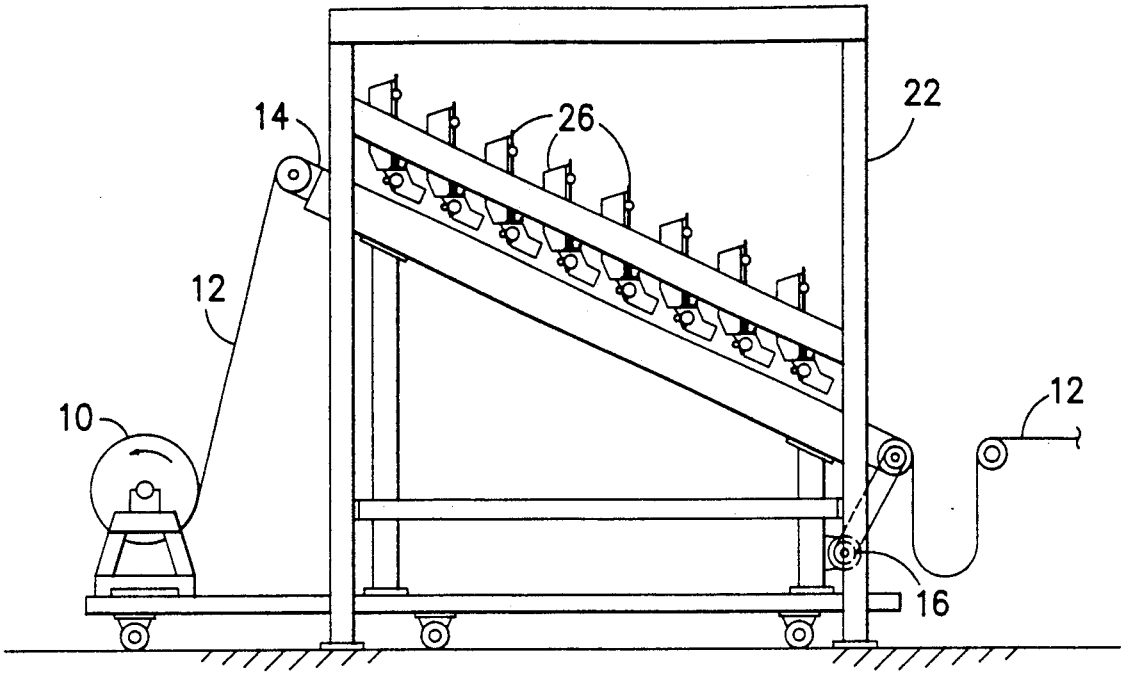
FIG. 1 is a diagrammatic side view of the array configuration of a dyeing apparatus of a kind for which the instant invention may be adapted, depicting eight dye-emitting arrays positioned above a section of a substrate web to be patterned.

Referring to FIGS. 1-11 hereof which show a highly preferred and advanced jet machine of the type described immediately above, FIG. 1 depicts, in a side elevation view, a set of eight individual arrays 26 positioned within frame 22. These arrays form part of a pattern dyeing machine to which the present invention is particularly suited. The term "dyeing" as used herein is also inclusive of other chemical treatments such as dye reducing and color discharge. Each array 26 is comprised of a plurality of dye jets, arranged in spaced alignment, and extends generally above and across the width of substrate 12. Substrate 12 is supplied from a feed unit such as roll 10 and is transported in turn under each array 26 by conveyor 14 driven by a suitable motor and/or pulley arrangement indicated generally at 16. After being transported under array 26, substrate 12 may be passed through other chemical treating or dyeing-related process stations or steps such as drying, fixing, or the like.

Figure 2:
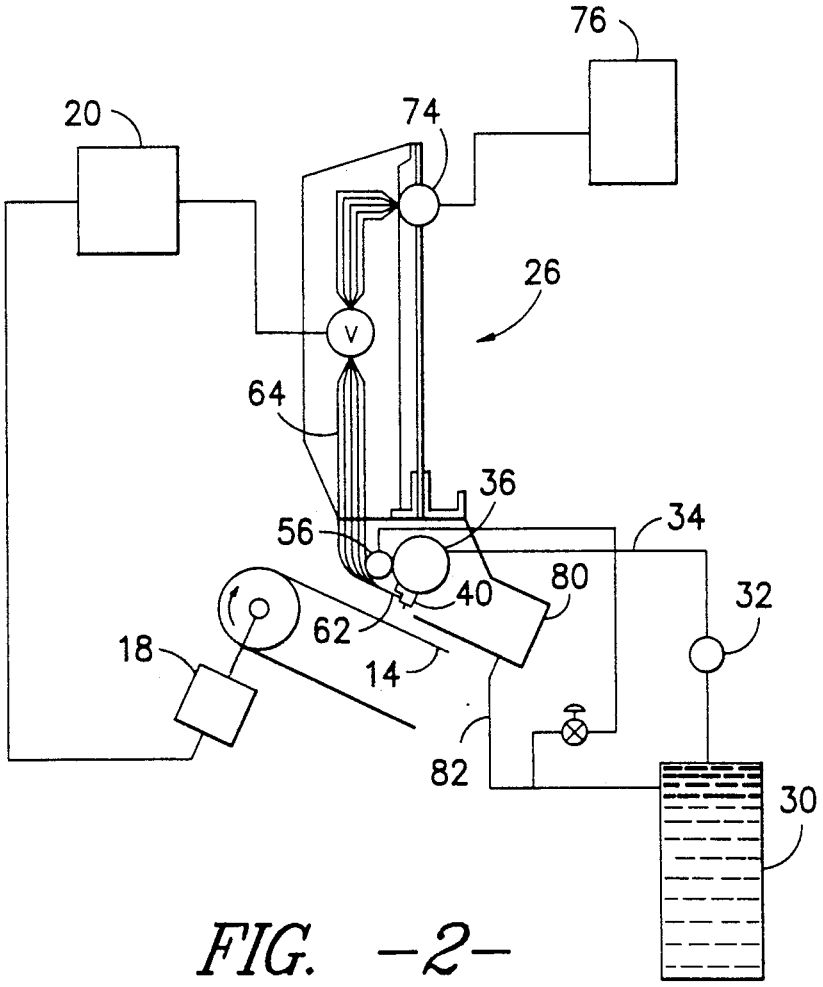
FIG. 2 is a schematicized diagram of a portion of the apparatus of FIG. 1.

FIG. 2 depicts, in schematic form, a side elevation of one dye-emitting array of the machine of FIG. 1. For each such array shown generally at 26, a separate dye reservoir tank 30 supplies liquid dye under pressure, by means of pump 32 and dye supply conduit means 34, to a primary dye manifold or plenum assembly 36 of the array. Primary manifold assembly 36 communicates with and supplies dye to dye sub-manifold assembly or plenum 40 (shown in greater detail in FIGS. 5 and 6) at suitable locations along their respective lengths. Both manifold assembly 36 and sub-manifold assembly 40 extend across the width of conveyor 14 on which the substrate to be dyed is transported. Sub-manifold assembly 40 is provided with a plurality of spaced, generally downwardly directed dye passage outlets 52 (shown, e.g., in FIG. 6) positioned across the width of conveyor 14 which produce a plurality of parallel dye streams which are directed onto the substrate surface to be patterned.

Figure 6:
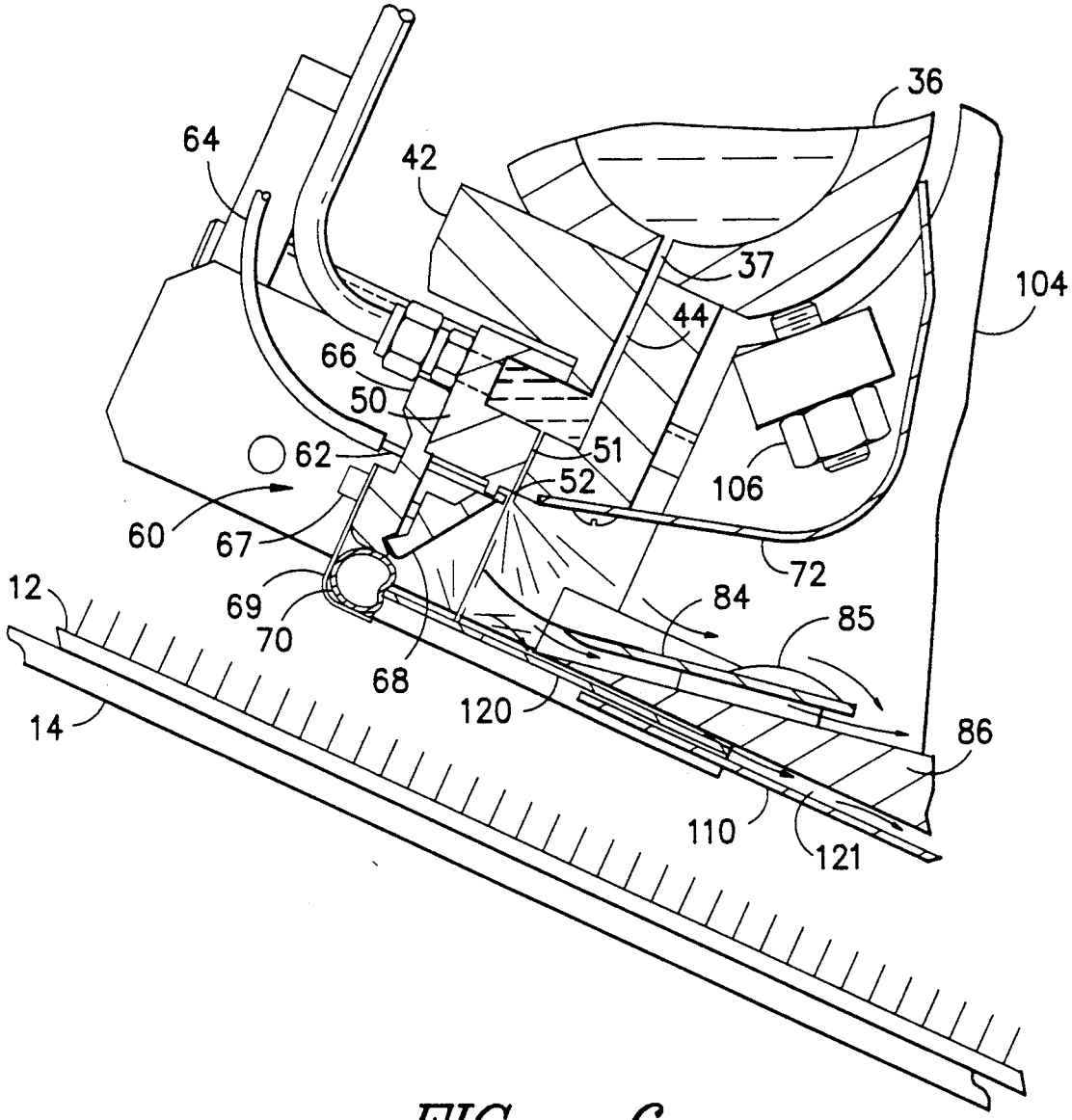
FIG. 6 is a further enlargement of a portion of the view of FIG. 5.
Figure 7:
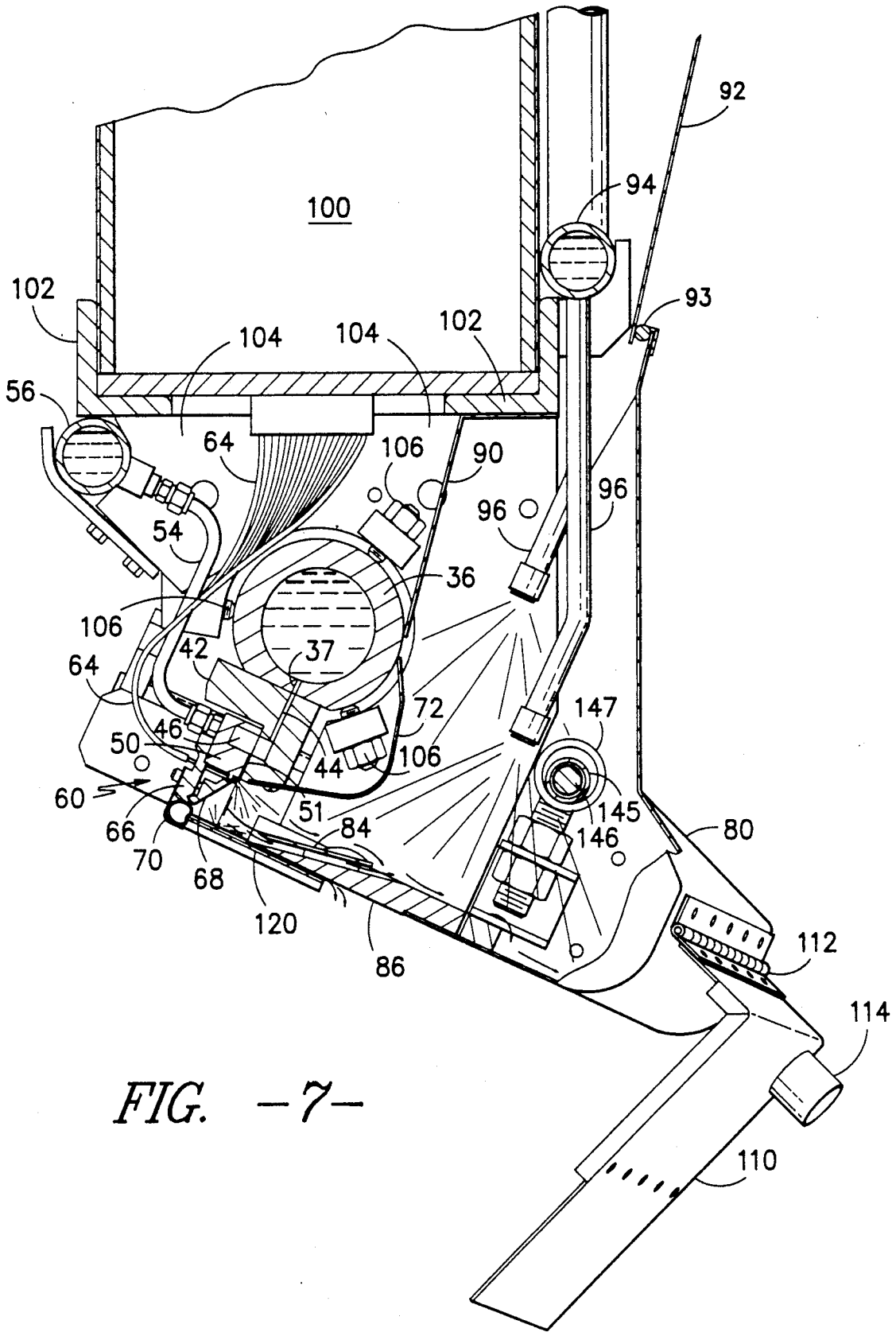
FIG. 7 shows the array of FIG. 5 with the secondary drain tray in a lowered position, as for occasional maintenance.
Figure 8:
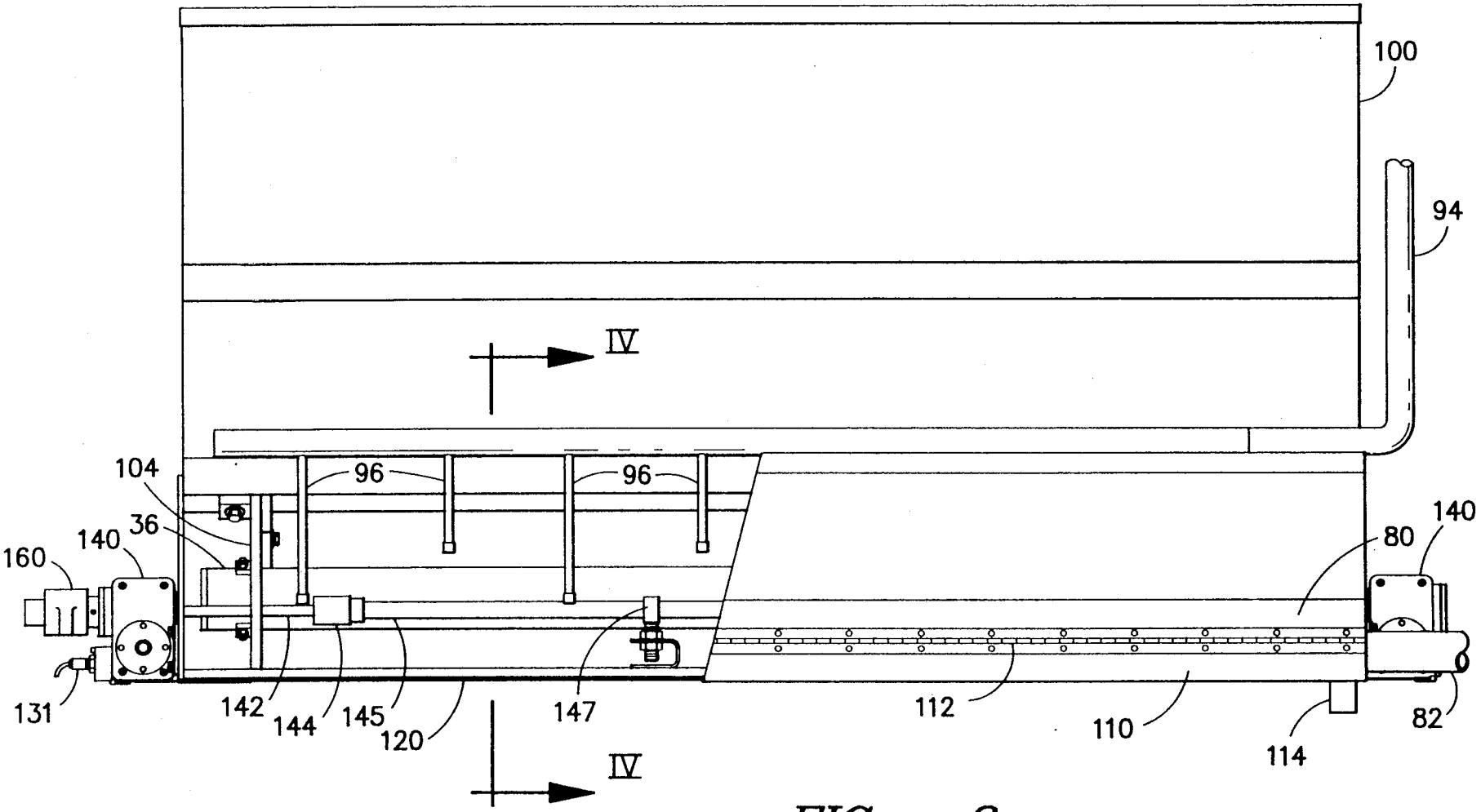
FIG. 8 shows, in partial section, a rear view (i.e., view looking from right to left in FIG. 5) of the shutter/containment apparatus of the instant invention.

As shown in FIGS. 2 and 6, positioned in alignment with and approximately perpendicular to each dye passage outlet 52 in sub-manifold assembly 40 is the outlet of an air deflection tube 62. Each tube 62 communicates by way of an air deflection conduit 64 with an individual air valve, illustrated collectively at "V" in FIG. 2, which valve selectively interrupts the flow of air to air tube 62 in accordance with pattern information supplied by pattern control device 20. Each valve is, in turn, connected by an air supply conduit to a pressurized air supply manifold 74 which is provided with pressurized air by compressor 76. Each of the valves V, which may be of the electromagnetic solenoid type, are individually controlled by electrical signals from a pattern control device 20. The outlets of deflection tubes 62 direct streams of air which are aligned with and impinge against the continuously flowing streams of dye flowing from dye passage outlets 52 and deflect such dye streams into a primary collection chamber or through 80, from which liquid dye may be removed, by means of a suitable dye collection conduit means 82, to dye reservoir tank 30 for recirculation.

The pattern control device 20 for operating solenoid valves V may be comprised of various pattern control means, such a computer with pattern information storage capabilities. Desired pattern information from control device 20 is transmitted to the solenoid valves of each array at appropriate times in response to movement by conveyor 14 which is detected by suitable rotary motion sensor or transducer means 18 operatively associated with the conveyor 14 and connected to control device 20. Details of one means to perform this function may be found in commonly assigned U.S. Pat. No. 4,033,154, issued Jul. 5, 1977, which disclosure is hereby incorporated by reference.

In a typical dyeing operation utilizing such apparatus, so long as no pattern information is supplied by control device 20 to the air valves V associated with the array of dye outlets 52, the valves remain "open" to permit passage of pressurized air from air manifold 74 through air supply conduits 64 to continuously deflect all of the primary collection chamber 80 for recirculation. When the substrate 12 initially passes beneath the dye outlets 52 of the individual arrays 26, pattern control device 20 is actuated in suitable manner, such as manually by an operator. Thereafter, signals from transducer 18 prompt pattern information from pattern control device 20. As dictated by the pattern information, pattern control device 20 generates control signals to selectively "close" appropriate air valves so that, in accordance with the desired pattern, deflecting air streams at specified individual dye outlets 52 along the array 26 are interrupted and the corresponding dye streams are not deflected, but instead are allowed to continue along their normal discharge paths to strike the substrate 12. Thus, by operating the solenoid air valves of each array in the desired pattern sequence, a colored pattern of dye is placed on the substrate during its passage under the respective array.

FIGS. 3 through 7 depict end views, in partial or full section, of the arrays 26 of FIGS. 1 and 2 which are equipped with the invention disclosed herein. Individual support beams 102 for each array 26 extend across conveyor 14 and are attached at each end to diagonal frame members 24. Perpendicularly affixed at spaced locations along individual support beams 102 are plate-like mounting brackets 104, which provide support for primary dye manifold assembly 36 and associated apparatus, primary dye collection chamber 80 and associated apparatus, and the apparatus associated with the instant invention. In a preferred embodiment, valve boxes 100, supported by beams 102, may be used to house collectively the plurality of individual valves V, as well as the air manifold 74 associated with each array.

As depicted most clearly in FIGS. 4 through 7, primary dye manifold assembly 36 is comprised of a pipe having a flat mating surface which accommodates a corresponding mating surface on sub-manifold assembly 40. Sub-manifold assembly 40 is comprised of sub-manifold module section 42, grooved dye outlet module 50, and an elongated sub-manifold section 46 cooperatively formed by elongated mating channels in sub-manifold section 42 and outlet module 50. Sub-manifold module 42 is attached to primary dye manifold assembly 36 by bolts (not shown) or other suitable means so that drilled outlet conduits 37 in the mating surface of manifold assembly 36 and corresponding drilled passages 44 in the mating surface of sub-manifold module section 42 are aligned, thereby permitting pressurized liquid dye to flow from the interior of manifold assembly 36 to elongated sub-manifold 46.

Associated with the mating face of dye outlet module 50 are a plurality of grooves or channels 51 which, when dyes outlet module 50 is mated to sub-manifold module 42 as by bolts or other appropriate means (not shown), form dye passage outlets 52 through which uniform quantities of liquid dye from sub-manifold 46 may be directed onto the substrate in the form of aligned, parallel streams. The relative position or alignment of dye channels 51 with respect to primary dye collector plate 84 and collector plate support member 86 may be adjusted by appropriate rotation of jacking screws 106 associated with mounting brackets 104.

Associated with dye outlet module 50 is deflecting air jet assembly 60, shown most clearly in FIG. 6, by which individual streams of air from air tubes 62 may be selectively directed, via an array of valves in valve box 100 and connecting supply conduits 64, across the path of respective dye streams. Assembly 60 is comprised of an air supply tube support plate 66 and air tube clamp 68, intended to align and secure individual air deflecting tubes 62 immediately outside dye outlets 52. By rotating air tube clamp screw 67, the pressure exerted by clamp 68 on air tubes 62 may be adjusted. Airfoil 72, positioned generally opposite air tubes 62, is intended to reduce the degree of turbulence within the region of the array due to the action of the transverse air streams issuing from tubes 62. Although not shown, the protruding portion of dye outlet module 50 against which air tube clamp 68 urges tubes 62 is preferably configured with a series of V-shaped notches into which tubes 62 may partially be recessed. Further details of a similar alignment arrangement may be found in commonly assigned U.S. Pat. No. 4,309,881.

Figure 5:
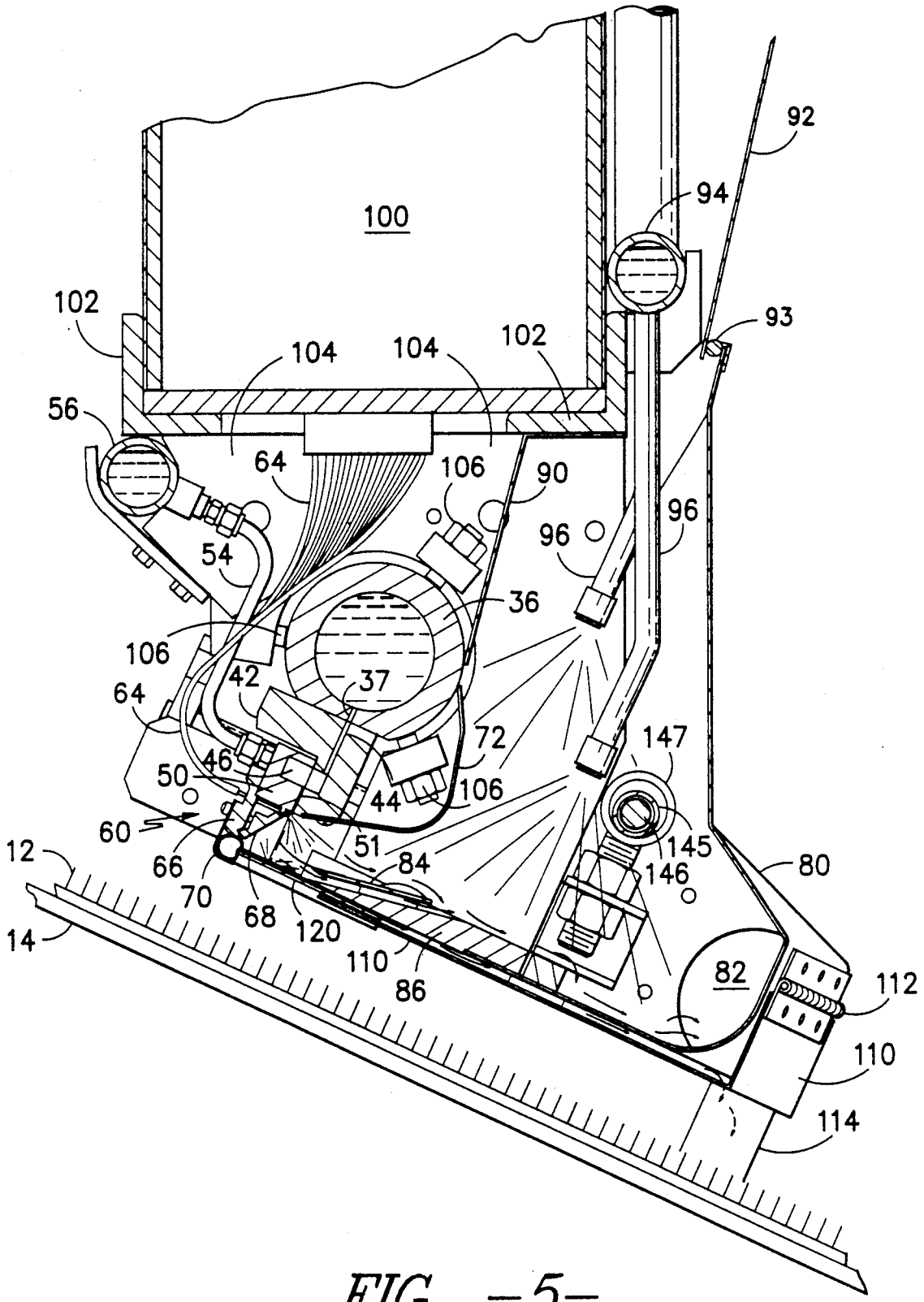
FIG. 5 is an enlarged view of the right array of FIG. 4, detailing the presumed flow of water within the array during the cleaning operation and showing such flow around the engaged or interposed shutter portion of the present invention.

Also associated with dye outlet module 50 is dye by-pass manifold 56 and by-pass manifold conduit 54, shown most clearly in FIG. 5, which collectively act as a pressure ballast and provides for a uniformly pressurized dye supply within sub-manifold 46.

When the liquid dye stream is deflected, the liquid dye exiting from dye passage outlets 52 is directed into primary dye collector chamber 80, which may be formed of suitable sheet material such as stainless steel and extends along the length of the array 26. Associated with collection chamber 80 is a primary dye collector plate 84 which is comprised of a thin flexible like blade-like member which is positioned parallel and closely adjacent to dye passage outlets 52. Primary collector plate 84 may be adjustably attached at spaced locations along its length, as by bolt and spacer means 85, to wedge-shaped elongate collector plate support member 86, which forms an extension of the floor of primary collection chamber 80 and which is sharpened along the edge nearest the outlets 52 of dye discharge channels 51 and extends along the length of array 26. Any suitable adjustment means by which a thin, blade-like collector plate 84 may be mounted under tension along its length and aligned with the axes of dye outlet module grooves 51 may be employed; one such means is disclosed in commonly assigned U.S. Pat. No. 4,202,189.

As shown in FIG. 5, primary dye collection chamber 80 is positioned generally opposite the array of air deflection tubes 62 for the purpose of collecting liquid dye which has been diverted from the dye streams by the transverse air stream from tubes 62. Primary dye collection chamber 80 also captures and collects partially diverted water sprayed at high pressure from manifold assembly 36, as well as water sprayed from staggered cleaning water nozzles 96 associated with wash water manifold 94, whenever the array is cleaned, e.g., when use of a different color dye is to be used. Primary dye collection chamber 80 may be attached by conventional means to mounting brackets 104 as well as to sharpened collector plate support member 86, which may be rabbeted to accommodate the floor of chamber 80, as shown, and forms a cavity into which dye or wash water may be collected and removed from the interior of the array via primary dye collection conduit 82. Mist shield 90, which generally extends the length of the array, is attached to the bottom of the valve box 100 using bolts or other suitable means, not shown. Shield 90 prevents wash water or dye, either in the form of droplets or airborne mist, from traveling between the manifold 36 and the valve box 100 and dripping onto and staining the substrate from that side of the array. Mist shield 92, also attached to valve box 100, uses spring force to compress elastomeric seal 93 which is attached to the dye collection chamber 80. Shield 92 and seal 93 prevent wash water, primarily in the form of airborne mist, from exiting the top of the dye collection chamber 80 and settling onto the substrate below. Both shields 90 and 92 and dye collection chamber 80 are preferably open at both ends so as to allow the pressurized air from air deflection tubes 62 to escape without undue restriction.

A principal component of the instant invention, secondary drain tray 110 extends along the length of primary dye collection chamber tray 80 and is attached thereto by means of hinge 112, which allows secondary drain tray 110 to swing away from the underside of array 26 for occasional cleaning and maintenance. When in position under array 26, secondary drain tray 100 may be secured through apertures (shown in FIG. 7) in the underside of tray 110 which are aligned with corresponding holes (not shown) in the primary dye collection chamber 80 by means of bolts or other suitable means, not shown. A fixed distance is held between the secondary drain tray 110 and primary dye collection chamber 80 through use of spacers. Liquid collected by secondary drain tray 110 may be collected by gravity and discharged through drain pipe 114, as indicated in FIG. 5. This liquid is transported through a suitable conduit to a waste water drain.

Associated with the unhinged end of secondary drain tray 110 is a movable shutter or shield 120, which is comprised of a thin elongate plate to which, in a preferred embodiment, tension is applied in a lengthwise direction in order to reduce sag and assure proper alignment and fit. Such tension may be introduced by a series of spring washers, as shown at 124 in FIG. 10, similar to the means by which collector plate 84 may be tensioned. As best shown in FIG. 6, shield 120 is positioned to move freely within the elongate gap 121 between the inside surface of secondary drain tray 110 and the lower surface of primary dye collector plate support member 86. When in an extended position, as when a cleaning operation is underway, the leading edge of shield 120 abuts tubular seal 70 in liquid-tight association. Seal 70 may be affixed to air tube support plate 66 via seal bracket 69, and air tube clamp screw 67. The trailing edge of shield 120 remains within gap 121 to an extent sufficient to assure that liquid flowing along the surface of shield 120 and under collector plate support member 86 towards the trailing edge of shield 120 must continue to flow within gap 121 and along the inside surface of secondary drain tray 110 toward hinge 112, and not flow between shield 120 and tray 110 and thereby into the substrate 12. When the operation is completed and liquid dye is again to be directed onto the substrate, shield 120 is moved to a position substantially totally within gap 121 formed by the inside surface of secondary drain tray 110 and collector plate support member 86, as depicted in the left hand array of FIG. 3 and 4.

Figure 9:
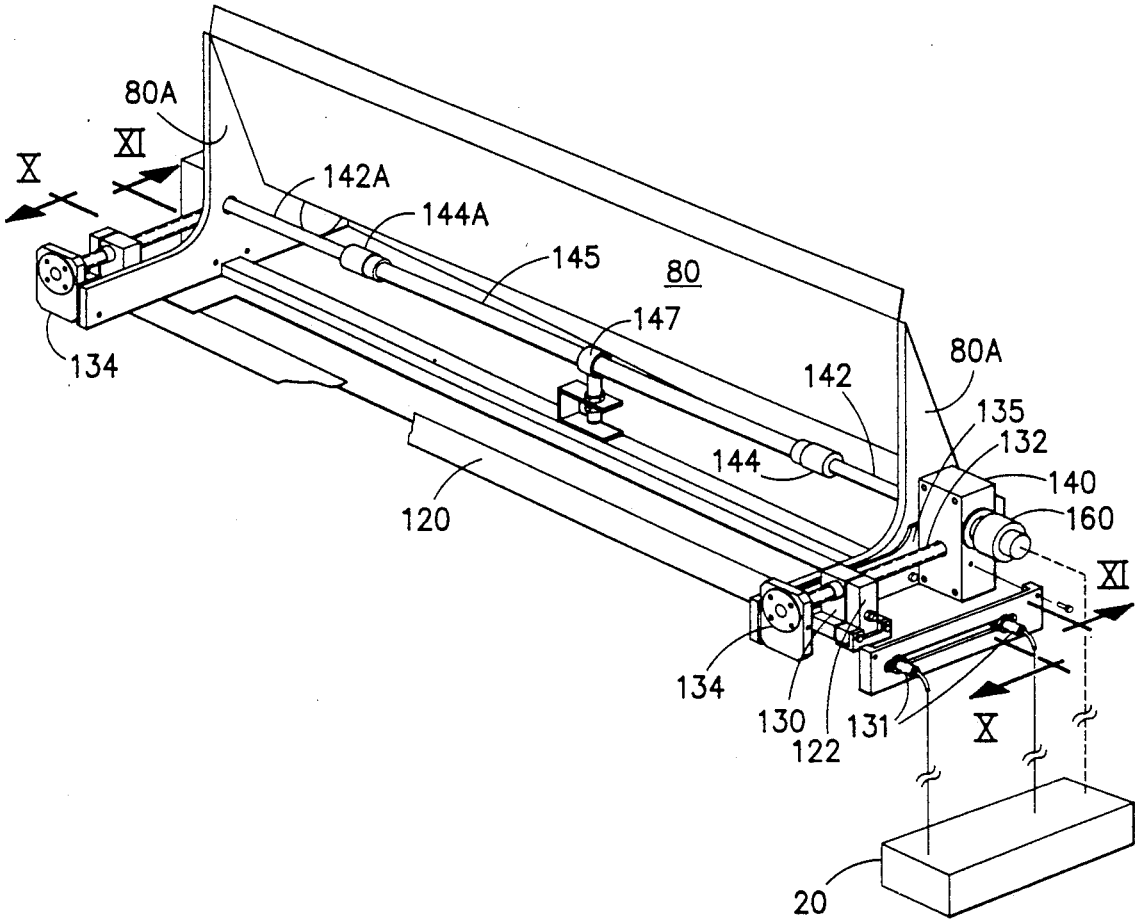
FIG. 9 is a perspective diagrammatic view of the shutter/containment apparatus of the instant invention, further showing a preferred means by which the shutter may be actuated.
Figure 10:
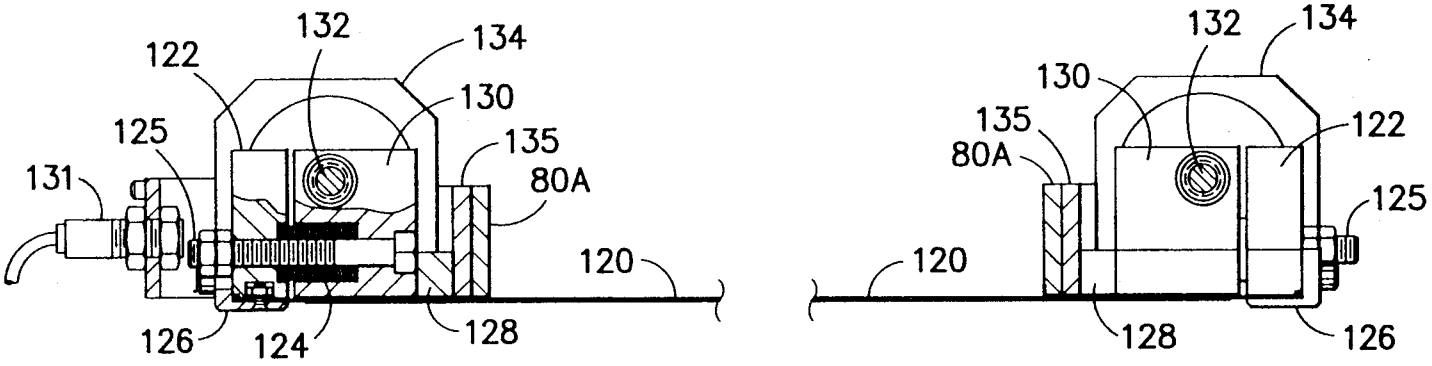
FIG. 10 is a view of the shutter/containment apparatus of FIG. 9, as seen along lines X—X of FIG. 9 with the left-most shutter shuttle assembly shown in partial section.

As best shown in FIGS. 9 and 10, shield 120 extends under the side portions 80A of primary dye collection chamber 80, under a wear plate 128, and under shield shuttle 130, which contains an internal chamber suitable for accommodating a stack of opposing Bellville-type spring washers 124 surrounding a tensioning bolt 125. Tensioning bolt 125 also pass through pressure plate 122, to which is attached the end-most portion of shield 120, via a conventional clamp and screw arrangement shown generally at 126. The configuration provides for the controlled application of tension on shield 120 by the compression of washers 124, and also couples shield 120 to moveable shuttle 130. When shuttle 130 is driven along the length of rotating shuttle guide threaded shaft 132, as described in more detail below, shield 120 is constrained to follow, without change in the tension applied to shield 120.

Figure 3:
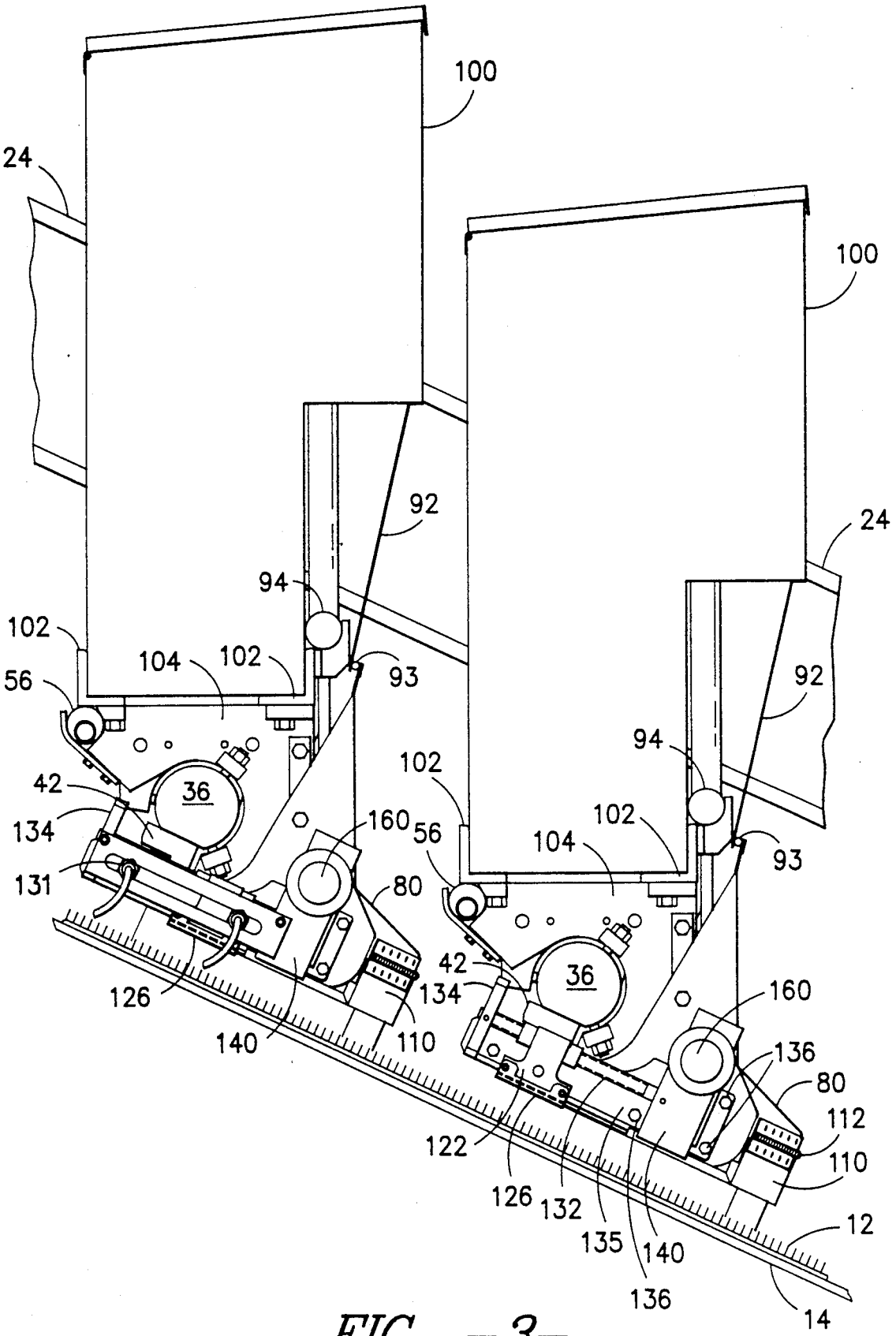
FIG. 3 is a diagrammatic side view of two of the arrays depicted in FIG. 1, in which the right array is shown with the shutter device of the instant invention in a closed or engaged position, while the left array is depicted with the shutter device in an open or disengaged position, and further is depicted with a set of proximity sensors in place to detect the position of the shutter device.
Figure 4:
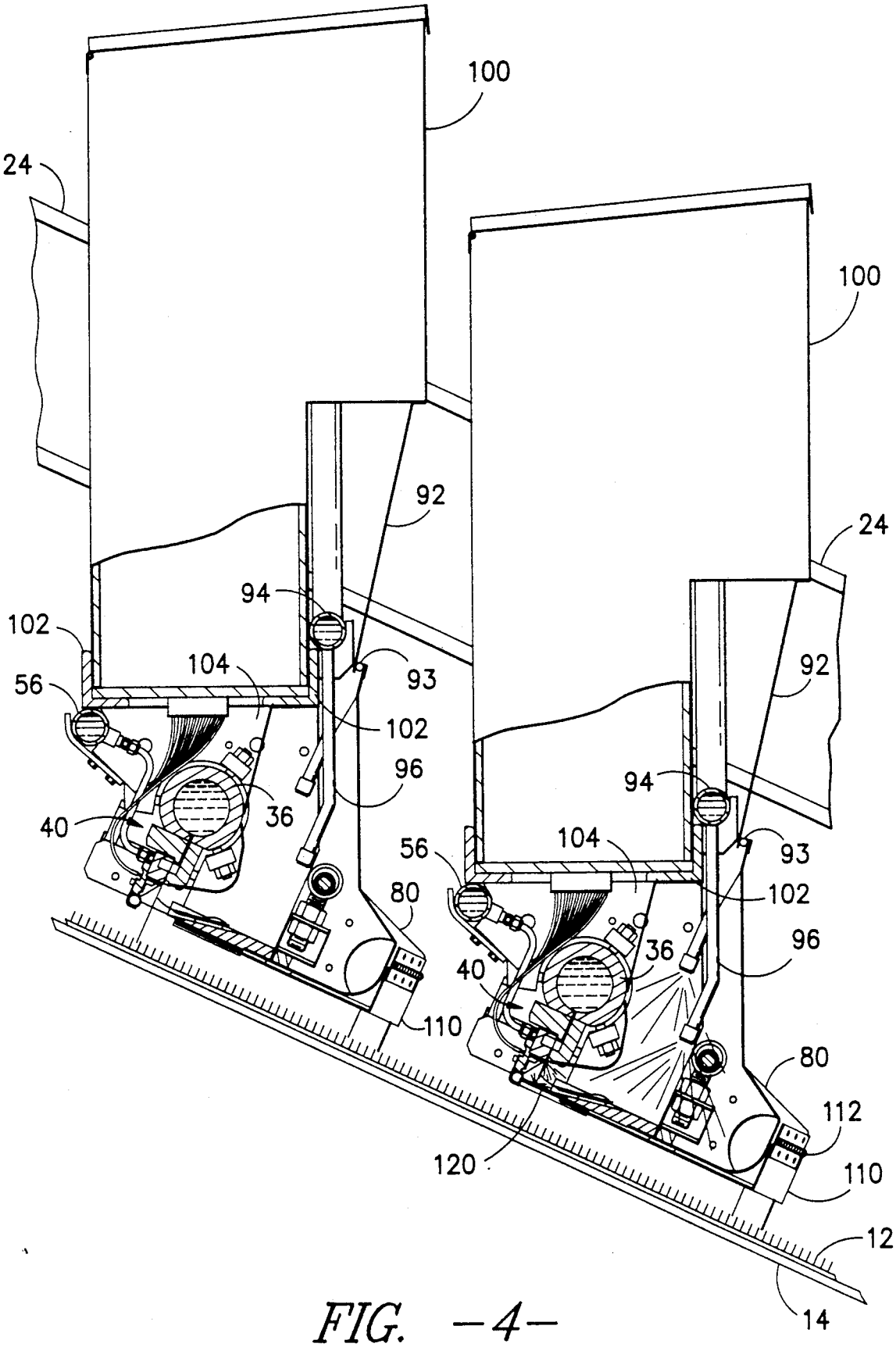
FIG. 4 is a view similar to FIG. 3, but taken along a vertical plane which intersects the array at an interior location, as depicted in FIG. 8 along line IV—IV, to shown the interior of the arrays. The right array is depicted with a wash system engaged.

The means by which shield 120 may be reversibly and reliably moved from a "closed" to an "open" position (and vice versa) without skewing is best described with reference to FIGS. 3, 9, and 11. At each outside end of array 26, shield 120 is attached to a moveable shuttle 130 which is associated with shuttle guide threaded shaft 132, which extends alongside array 26 in a direction generally aligned with conveyor 14 within the region of dye outlets 52. Shuttle guide shaft 132 is supported at one end by shaft support plate and bearing 134 which allows for the free rotation of shaft 132. The opposite end of shuttle guide shaft 132 is supported by gear box 140. Both shaft support plate 134 and gearbox 140 are permanently attached to gearbox mounting plate 135 which, in turn, is adjustably attached with bolts 136 to the end plates 80A of the primary dye collection chamber 80. If desired, a bellows or similar sleeve may be used to protect threaded shaft 132 from dirt, dyestuffs or other contaminants.

Figure 11:
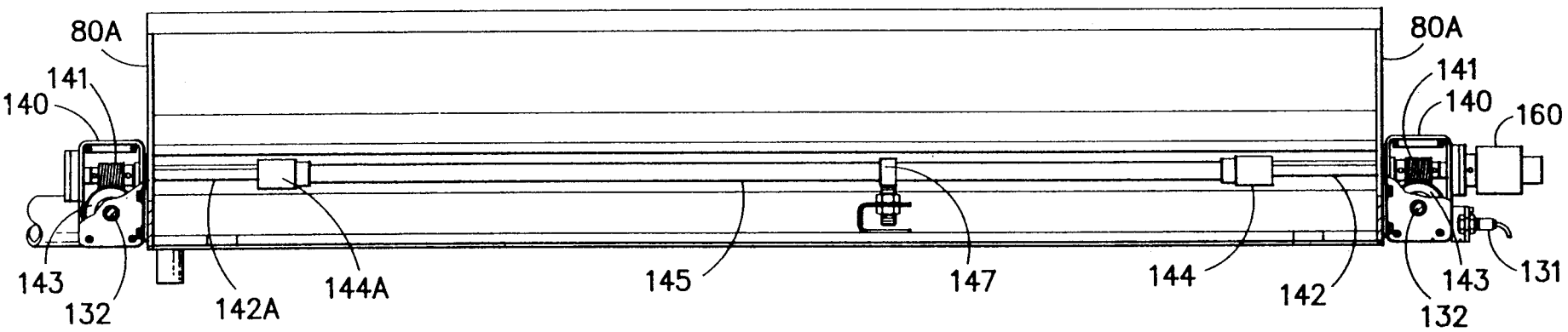
FIG. 11 is a view of the shutter/containment apparatus of FIG. 9, as seen along line XI—XI of FIG. 9, with the gear boxes shown in partial section.

The gearboxes 140 on either side of the dye collection chamber 80 are connected together by a conventional flexible drive shaft assembly as better shown in FIGS. 7, 8, 9, and 11. The flexible drive shaft assembly consists of a spirally wound inner steel core 146 which rotates within and is protected by an impermeable casing 145. The steel core is rigidly attached at both ends to shaft couplings 144 and **144*a*. The flexible drive shaft assembly is supported neat its midpoint by shaft alignement collar 147. As seen in FIG. 11, motor 160 is directly connected to rigid drive shaft 142 to which is also connected worm 141. Rotation of the motor 160 imparts a direct rotation of worm 141 which in turn drives worm gear 143 with a corresponding fixed speed reduction. Worm gear 143 is directly attached to the shuttle guide threaded shaft 132. The torque of motor 160 may therefore be enhanced by the combined mechanical advantages imparted by the worm gearing and the screw threads on threaded shaft 132, which threads serve to drive shuttle 130 (and shield 120) in the desired linear direction. Through the connection offered by the flexible drive shaft assembly, the gearboxes on each side of the array 26 are constrained to rotate in unison, which, in turn, synchronously propels the shuttle 130 on each side of the array in the direction appropriate to the direction of guide shaft 132 rotation. A particular advantage of this system is that it minimizes any skewing of the shield 120 due to movement of the ends of the shield 120 at different rates. A further advantage is the slow even movement of the shuttle 130** which does not impart vibration or shock to the sensitive dye manifold assembly.

Reversible motor 160 may use any appropriate type of drive; a pneumatic motor has been found to be particularly satisfactory in terms of size and reliability.

As depicted in FIG. 9, a set of inductive proximity switches 131 or the like may be adjustably positioned to detect the arrival of shuttle 130 at the desired end points of travel, and to disengage motor 160 as appropriate. Connecting proximity switches 131 and motor 160 to pattern control device 20 allows pattern control device 20 to sense the position of shield 120. It is intended, using such switches 131, that the motion of shield 120 may be controlled (i.e., both initiated and terminated) in response to the pattern control device 20, as appropriate, thereby providing for the automatic cleaning/color changing of arrays which are no longer needed to produce a given pattern, in preparation for the production of a different pattern. The details of automatically and electronically changing from one pattern to another is set forth in U.S. Pat. No. 4,170,883, the disclosure of which is hereby incorporated by reference.

Suitable other jet type apparatus is disclosed in U.S. Pat. Nos. 4,084,615; 4,034.584; 3,985,006; 4,059,880; 3,937,045; 3,942,342; 3,939,675; 3,892,109; 3,942,343; 4,033,154; 3,969,779; 3,894,413; and 4,019,352, 4,033,154; 4,116,626; 4,434,632; 4,584,854; the disclosures of each of said patents hereby being expressly incorporated by reference.

Reducible dyes which can be used singly or in admixture to provide the ground dye component to which the present process is applicable include vat, reactive, mordant, acid, metallized, direct and disperse, and exemplary ones are those disclosed in U.S. Pat. Nos. 3,104,150; 3,077,370; 2,164,930; 2,206,535; 2,248,128; 4,610,802; 4,441,883; and in the following articles: "MANO FAST IN TEXTILE PRINTING," P. Krug, Rayon and Synthetic Fibres Supplement; pp. 939–947; "G. Bertolina, et al., *Coloured Discharge Technique*, Dyer, 114, pp 775–779 (1955); "Thiourea Dioxide (Formamidinesulfinic Acid) A New Reducing Agent For Textile Printing," P. Krug, J.S.D.C. 69, December 1953, pp. 606–611, the disclosures of all of which are hereby expressly incorporated herein by reference.

Dyes particularly useful and preferred as the reduction resistant colorant component in the reduction system of the present invention, and which are also resistant, for the most part, to oxidation, include the following: Direct Yellow 28, Direct Yellow 58, Acid Red 226, Acid Violet 90, Acid Blue 61:1, Direct Blue 106, Acid Green 84, Acid Green 28, Intrachrome Black RPL. Other useful non-dischargeable dyes include, Acid Yellow 151, Direct Yellow 119, Direct Yellow 68, Acid Yellow 79, Direct Blue 108, Acid Yellow 5, Acid Black 188, Acid Blue 25, Acid Blue 59, Acid Blue 193, Acid Blue 278, Acid Blue 324, Acid Red 50, Acid Red 52, Acid Red 91, Acid Red 92, Acid Red 94, Acid Violet 103, Acid Green 41.

Dyes which are preferred for the dischargeable ground shades are: Acidol Scarlet ML, Acidol Yellow M5RL, Acidol Red MBR, Irgalan Bordeaux EL 200, Isolan Navy Blue, Telon Violet BL, Isolan Gray KPBL 200, Isolan Yellow KPRL, Isolan Yellow 8GL, Erional Rubine 5BLF, Irgalan Yellow GRL 200, Lanasyn Red SG, Lanasyn Orange S-RL, Lanasyn Dark Brown SGL, Lanasyn Yellow S-2GL, Nylasyn Red FMRL, Nylasyn Yellow, and Telon Fast Yellow A2GL.

Below are four typical and preferred structural and operating parameter sets for the jet apparatus described in the above in regard to FIGS. 1–11.

| Jet gauge (jets/inch) | orifice diameter in inches | Production operating reductant velocities (meters/second) low | high |
|---|---|---|---|
| 10 | 0.020 | 4.52 | 6.58 |
| 16 | 0.008 | 6.17 | 11.31 |
| 10 | 0.024 | 4.57 | 8.28 |
| 20 | 0.014 | 4.20 | 6.71 |

It has been found that many types of previously known reductant systems such as described in the above Bertolina, et al article, which are typically applied by screen, pad or the like cannot be employed in the present process due to unmanageable setting up of its components in the applicator, clogging of the jets and unacceptably inadequate reducing power with respect to the recipe requirements of the present apparatus, particularly on polyamide pile substrate such as Nylon 6 or 66. A highly preferred reductant recipe is shown in the aqueous recipe table below as number 3, employed in a series of comparative runs wherein the ingredient contents are expressed in grams/kilogram, on weight of the reductant system total recipe. A preferred range for the recipe 3 ingredients is also noted in the recipe table.

Recipe 1 in the table is taken from page 4513 *Dyes and Textile Chemistry*, cited above. Recipe 2 is identical to recipe 1 except zinc sulfate was added. Recipe 3 is a preferred reductant system of the present invention for use on medium to heavy ground shades.

| Grams/Kilogram of Total Reductant System | 1 | 2 | 3 | Preferred Range For 3 |
|---|---|---|---|---|
| Non-Reducible Dye (optional) | | | | |
| Zinc Sulfate (Redox assistant) | — | 50.0 | 10.0 | 1–50 |
| Thiourea Dioxide | 50.0 | 50.0 | 15.0 | 3–30 |
| Thiodiglycol | 100.0 | 100.0 | — | — |
| Water | 300.0 | 250.0 | 725.0 | 500–1000 |
| Anthraquinone Paste 30% active | 10.0 | 10.0 | — | — |
| British Gum (dextrin), 50% active | 540.0 | 540.0 | — | — |
| Xanthan Gum, 2% active | — | — | 250.0 | 150–350 |

Note:
1 The anthraquinone paste is prepared by dispersing with high energy shearing and/or ball milling for, e.g., twelve hours, 80 parts by weight of the 30% active aqueous anthraquinone, 10 parts by wt. Synfac 8216 (a Milliken Chemical nonionic surfactant), and 10 parts by wt. Tamol SN (a Rohm and Haas sulfonated naphthalene dispersant). The anthraquinone is a redox component.
2 The British gum was prepared as a 50% wt. paste from soluble starch (dextrin) from Fisher Scientific.
3 The Xanthan gum was prepared as a 2% wt. hydrolyzed Kelzan S product from Kelco.

PREPARATION OF SUBSTRATE SAMPLES

The Nylon 66 fiber was stock dyed (pot dyed) and the dyed fiber then blended, spun into yarn and fabricated into a pile substrate. Three different ground shade colors of pile substrates were prepared and used in the discharge tests.

| Blue Substrate: 80% dyed fiber and 20% undyed fiber. The dyed fiber composition was as follows with the dye weight percentage being on weight of fiber: | |
|---|---|
| Lanasyn Navy Blue SBL (C.I. Acid Blue 296) | 0.12% |
| Lanasyn Black SRL 80% wt. (C.I. Acid Black 218) | 0.24% |
| Lanasyn Yellow S-2GL (C.I. Acid Yellow 235) | 0.07% |
| Burgundy Substrate: 100% dyed fiber of the following composition: | |
| Lanasyn Rubine S-5BL | 0.48% |
| Lanasyn Red SG (C.I. Acid Red) | 0.40% |
| Lanasyn Yellow S-2GL | 0.17% |
| Lanasyn Black SHL 80% | 0.19% |
| Camel Substrate: 63% dyed fiber and 7% undyed fiber The dyed fiber composition was as follows: | |
| Lanasyn Yellow S-2GL | 0.21% |
| Lanasyn Red SG | 0.04% |
| Lanasyn Black SHL 80% wt. | 0.14% |

REDUCTANT RECIPE PREPARATION AND DISCHARGE TEST PROCEDURE

Recipe 1

To approximately one half of the total water of the recipe in one container the thiourea dioxide, the thiodiglycol and anthraquinone paste were added and thoroughly mixed. In another container were mixed thoroughly the remainder of the recipe water and the British gum. The contents of both containers were thoroughly mixed. The resulting reducing system was then pattern applied with a flat screen to each substrate which was then atmospherically steamed for 8 minutes, washed, and dried at 235° F. The resulting patterned discharge area showed little to no color discharge effects and virtually all of the color in each of the ground shades remained.

An identical reducing system was prepared as above and loaded into a jet printing machine of the general type described above in FIGS. 1–11. The reducing system would not circulate at all in the machine and hence no jet discharge tests were performed. Consequently, in an attempt to obtain a reasonable comparison, and as experience has shown, the technique of 10–12 passes in repetition of a flat screen which approximates the depth of pile penetration and wet pick-up achievable on the aforesaid machine was employed. Although it is obvious that this technique is not commercially practical, it is a useful laboratory tool and one that allows at least an approximate evaluation of the reduction efficacy of the prior art reductant systems and application methods as compared to the present invention. This multi-pass technique will henceforth be referred to as "jet simulation".

Jet simulation was performed using recipe 1 on each of the colored substrates which were then atmospherically steamed for 8 minutes, washed, and dried at 235° F. The patterned discharge areas of the substrates remained highly colored with the original ground color.

Recipe 2

Recipe 1 was repeated except that zinc sulfate 50 g/kg was added thereto. The resulting reducing system was then applied to each substrate with a flat screen, and the substrate then atmospherically steamed for 8 minutes, washed and dried at 235° F. The resulting discharge patterns were a vivid yellow on all three substrates after steaming and remained a dull pastel yellow color after drying. The discharge patterns had only penetrated into the yarn piles approximately 5% of their depth.

An identical reducing system was prepared using recipe 2 and loaded into the aforesaid jet printing machine. The reducing system would not circulate at all in the machine and hence no jet discharge tests were performed.

Jet simulation was performed using recipe 2 on each of the substrates, and the substrates then atmospherically steamed for 8 minutes, washed, and dried at 235° F. The substrates were highly colored upon removal from the steamer and the patterned discharge areas retained a dull yellow coloration after drying.

Recipe 3

Both jet simulation and actual jet application from the aforesaid machine were performed using recipe 3 on each of the substrates, which were then atmospherically steamed for 8 minutes, washed, and dried at 235° F. The substrates were substantially uncolored upon removal from the steamer and remained substantially uncolored for both the blue and camel ground shades. There was slight coloration on the substrates colored burgundy. It was clearly evident that the single pass through the jet machine had forced the reductant system substantially below the surface of the yarn piles.

In a preferred embodiment, the addition of a small amount of aldehyde, e.g., formaldehyde or benzaldehyde in concentrations of from about 0.5 to about 10.0 grams/kilogram of recipe is employed in the recipe to assist in eliminating residual color from substrates which are initially highly colored, e.g., as with the burgundy dye.

The best operation of the jet apparatus and method is achieved with the following aqueous reduction system and machine operating specifications:

| | | |
|---|---|---|
| (a) | Viscosity at 25° C. | 300–1200 cps |
| (b) | Temperature | 50–95° F. |
| (c) | Solids particle size (average diameter) | <10 microns |
| (d) | Concentration of Thiourea Dioxide on weight of reduction system | <30 g/kg |
| (e) | PH | 6.0–7.0 |
| (f) | Concentration of Zn $SO_4$ on weight of Reduction System | 1.0–50 g/k |

It is noted that the solids particle size refers to the various materials which are either brought into the system or formed therein and include insoluble agglomerations of gum materials, salts and gels, all of which in larger sizes can cause the jet apparatus to clog and fail.

Alternative materials to the $ZnSO_4$ include the various water soluble salts of zinc and other transition metals including Co, Cd, Cu, Zr, and the like.

It is preferred that xanthan gum or guar be used to adjust the viscosity of the reductant system; however, in general, aqueous system thickners of both the naturally derived organic type and synthetically derived organic polymeric type may be employed. The Xanthan gum is of course commercially available and well known and described, e.g., in Condensed Chemical Dictionary, 9th Edition, Van Nostrand, 1977, as a synthetic biopolymer made by fermentation of carbohydrates. Typical examples of useful aqeuous system thickners are as follows:

I. Organic-Naturally Derived Type

Includes: "Alginates," such as "Carrageenan," and agar, and their salts; algin alkyl-carbonates, acetates, propionates and butyrates; pectins, amylopectin, and derivatives; gelatin; starches and modified starches including alkoxylated forms, such as esters and ethers; Cellulose derivatives, such as sodium carboxymethylcellulose (CMC), hydroxyethylcellulose (HEC), carboxymethylhydroxyethyl cellulose (CMHEC), ethylhydroxyethyl cellulose (EHEC), and methylcellulose (MC); Casein and its derivatives; Xanthomonas gums, such as xanthan gum; Dextrans of low molecular weights; and Guar gums.

II. Organic-Synthetically Derived Type

Includes polymers of acrylic acid or methacrylic acid, and their metallic salts, esters, and amides; copolymers of acrylic/methacrylic acids and/or their metallic salts, esters amides, and/or polymers of any or all of these forms; polyamides (e.g. see U.S. Pat. No. 2,958,665); vinyl polymers, such as substituted vinyls, vinyls ester polymers, etc.; polyalkoxylated glycol ethers of high molecular weight; and amine salts of polycarboxylic acids (Alginates, polyacrylates, glycolates, etc.).

III. Combinations Of Above Types (A) Includes resins prepared by crosslinking one or more of the above organic polymers with each other or with other polyhrdric materials (aldehydes, alcohols, diols, ethers, etc.). For example:

(1) crosslinked 1:1 maleic anhydride-methyl vinyl ether copolymer with diethylene glycol divinyl ether or with 1,4-butanediol divinyl ether;
(2) methyl cellulose with glyoxal crosslinks;
(3) hydrolyzed polyacrylonitrile crosslinked with formaldehyde or acetaldehyde (e.g. see U.S. Pat. No. 3,060,124);
(4) polyacrylate polymers with maleic anhydride and styrene; and
(5) Carrageenan with cellulose methyl ether.

(B) Include the addition of certain inorganic salts to one or more of the above organic polymers. For example:

(1) calcium phosphate added to an aqueous solution of Alginate salts;
(2) Carageenan with alkali metal salts (e.g. KCl) added;
(3) increased gelation of gums or polyvinyl polymers by addition of borates; and
(4) Xanthomonas gum with trivalent metal salts such as $Al_2(CO_4)_3$ and a H-displacing metal such as Zn or Ni.

Of these, the gum type thickeners, such as guar gum and Xanthomonas gums are preferred. Representative of these include the products sold under the tradenames: V60-M Gum, from HiTek Polymer Co., a modified guar polygalactomannon gum; and Kelzan from Kelco division of Merke & Co., San Diego, Calif., an anionic biopolysaccharide Xanthomonas gums.

The amount of thickner added to the aqueous reducing solution is selected to provide the desired visosity which can range between about 20 to about 20,000 centipoise as measured at 25° C., with a No. 3 spindle in a Brookfield LVT viscometer. In general, amounts of thickener in the range of from about 0.1 to about 5.0 weight percent, based on the weight of the solution, can be most effectively employed. For jet machines, such as described above, thickener concentrations ranging from about 0.1 to about 1.0 weight percent of the reducing recipe provide viscosities at 25° C. of from about 50 to about 1,000 centipoise.

This invention has been described in detail with particular reference to preferred embodiments thereof, however, it is understood that variations and modifications can be effected within the spirit and scope of the invention.

What is claimed is:

1. A process for discharging the color from selected areas of a pile fiber, textile substrate dyed with a dischargeable dye, comprising the steps of:

jet forcing an aqueous reducing system onto an outer surface of said pile fiber, textile substrate with sufficient velocity to penetrate below said outer surface and downward along a length of said pile fibers wherein said velocity of said reducing system is between 2.0 and 20.0 meters per second; and heating said pile fiber, textile substrate to sufficiently activate said reducing system to reduce said dischargeable dye.

2. A process according to claim 1 wherein said pile fiber, textile substrate is heated by applying steam.

3. A process according to claim 2 wherein said reducing system contains from about 3 to 30 grams/kilograms of thiourea dioxide, from 1 to 50 grams/kilogram of soluble salts of one or more transition metals selected from Zn, Co, Cd, Cu, Ni or Zr, and an aqueous system thickener.

4. A process according to claim 3 wherein said soluble salt is zinc sulfate.

5. A process according to claim 4 wherein said aqueous system thickener is xanthan gum in a concentration from 1.0 to 20 grams/kilogram.

6. A process according to claim 3 wherein said velocity of said reducing system is between 4.0 and 12.0 meters per second.

7. A process according to claim 6 wherein said soluble salt is zinc sulfate.

8. A process according to claim 3 wherein said reducing system further contains an aldehyde in a concentration of from about 0.5 to about 10 grams/kilogram of reducing system.

9. A process according to claim 8 wherein said aldehyde is selected from formaldehyde and benzaldehyde.

10. A process according to claim 9 wherein said soluble salt is zinc sulfate.

11. A process according to claim 1 wherein said pile fibers are predominately polyamide fiber.

12. A process according to claim 3 wherein said dischargeable dye is selected from Acidol Scarlet ML, Acidol Yellow M5RL, Acidol Red MBR, Irgalan Bordeaus EL 200, Isolan Navy Blue, Telon Violet BL, Isolan Gray KPBL 200, Isolan Yellow KPRL, Isolan Yellow 8GL, Erional Rubine 5BLF, Irgalan Yellow GRL 200, Lanasyn Red SG, Lanasyn Orange S-RL, Lanasyn Dark Brown SGL, Lanasyn Yellow S-2GL, Nylasyn Red FMRL, Nylasyn Yellow, or Telon Fast Yellow A2GL.

13. A process according to claim 12 wherein said soluble salt is zinc sulfate.

14. A process according to claim 12 wherein said aqueous reducing system further comprises a reduction resistant colorant component selected from Direct Yellow 28, Direct Yellow 58, Acid Red 226, Acid Violet 90, Acid Blue 61:1, Direct Blue 106, Acid Green 84, Acid Green 28, Intrachrome Black RPL, Acid Yellow 151, Direct Yellow 119, Direct Yellow 68, Acid Yellow 79, Direct Blue 108, Acid Yellow 5, Acid Black 188, Acid Blue 25, Acid Blue 59, Acid Blue 193, Acid Blue 278, Acid Blue 324, Acid Red 50, Acid Red 52, Acid Red 91, Acid Red 92, Acid Red 94, Acid Violet 103, or Acid Green 41.

15. A process for discharging the color from selected areas of a pile fiber, textile substrate dyed with a dischargeable dye, comprising the steps of:

jet forcing an aqueous reducing system having from 3 to 30 grams/kilograms of thiourea dioxide, from 1 to 50 grams/kilogram of a soluble salt of one or more transition metals selected from Zn, Co, Cd, Cu, Ni and Zr, and an aqueous system thickener, onto an outer surface of said pile fabric, textile substrate at a velocity of 2 to 20 meters per second to penetrate below said outer surface to a depth of at least 50% of a length of said pile fiber; and steaming said pile fiber, textile substrate to sufficiently activate said reducing system to reduce said dischargeable dye.

16. A process according to claim 15 wherein said reducing system further comprises from 0.5 to 10 grams/kilograms of an aldehyde.

17. A process according to claim 16 wherein said aldehyde is selected from formaldehyde and benzaldehyde and wherein said soluble salt is zinc sulfate.

18. A pile fiber, textile substrate prepared according to the process of claim 15.

19. A process for discharging the color from selected areas of a pile fiber, textile substrate dyed with a dischargeable dye, wherein said pile fibers are in the form of yarns, comprising the steps of:

jet forcing an aqueous reducing system onto an outer surface of said pile fiber, textile substrate with a velocity of between 2.0 and 20.0 meters per second to penetrate below said outer surface and downward along a length of said fibers whereby said fibers are contacted and substantially coated with said reducing system from their outer ends inwardly along at least on half of their total lengths; and heating said pile fiber, textile substrate to sufficiently activate said reducing system to reduce said dischargeable dye.

20. A process according to claim 19 wherein said pile fibers are heated by applying steam.

21. A process according to claim 19 wherein said reducing system contains for about 3 to 30 grams/Kilogram of thiourea dioxide, from 1 to 50 grams/kilogram of soluble salts of one or more transition metals selected from Zn, Co, Cd, Cu, Ni or Zr, and an aqueous system thickener.

22. A process according to claim 21 wherein said soluble salt is zinc sulfate.

23. A process according to claim 22 wherein said aqueous system thickener is xanthan gum in a concentration from 1.0 to 20 grams/kilogram.

24. A process according to claim 21 wherein said velocity of said reducing system is between 4.0 and 12.0 meters per second.

25. A process according to claim 24 wherein said soluble salt is zinc sulfate.

26. A process according to claim 21 wherein said reducing system further contains an aldehyde in a concentration of from about 0.5 to about 10 grams/Kilogram of reducing system.

27. A process according to claim 26 wherein said aldehyde is selected from formaldehyde and benzaldehyde.

28. The process according to claim 27 wherein said soluble salt is zinc sulfate.

* * * * *